US010280623B1

(12) United States Patent
Verelli et al.

(10) Patent No.: US 10,280,623 B1
(45) Date of Patent: May 7, 2019

(54) MULTIFUNCTIONAL REBAR SUPPORT SYSTEM FOR REINFORCEMENT OF CONCRETE STRUCTURES

(71) Applicants: Angelo Verelli, LaSalle (CA); Carlo Verelli, LaSalle (CA)

(72) Inventors: Angelo Verelli, LaSalle (CA); Carlo Verelli, LaSalle (CA)

( * ) Notice: Subject to any disclaimer, the term of this patent is extended or adjusted under 35 U.S.C. 154(b) by 0 days.

(21) Appl. No.: 15/803,339

(22) Filed: Nov. 3, 2017

(51) Int. Cl.
*E04C 5/20* (2006.01)

(52) U.S. Cl.
CPC ..... *E04C 5/20* (2013.01)

(58) Field of Classification Search
CPC . E04C 5/166; E04C 5/168; E04C 5/20; E04C 5/206
See application file for complete search history.

(56) References Cited

U.S. PATENT DOCUMENTS 3,830,032 A * 8/1974 Robb ..... E04C 5/206 52/687
4,644,727 A * 2/1987 Hanson ..... E04C 5/08 52/678
4,835,933 A * 6/1989 Yung ..... E04C 5/168 248/74.4
6,089,522 A * 7/2000 Haslem ..... E04C 5/206 248/440

(Continued)

FOREIGN PATENT DOCUMENTS

FR 1461351 A * 2/1966 ..... E04C 5/20
FR 3020664 A1 * 11/2015 ..... E04C 5/20

(Continued)

*Primary Examiner* — Christine T Cajilig
(74) *Attorney, Agent, or Firm* — Equinox IP Inc.

(57) ABSTRACT

A rebar support system used in the reinforcement of concrete structures is disclosed, comprising a rebar support tower and a rebar support base, individually capable of holding rebar members at a predefined height within a range of possible heights, the two further capable of acting together in tower-base duplex fashion in the formation of multilevel rebar grids. The rebar tower has four legs between which there are defined two intersecting passages, the legs being open-ended at the bottom and forming bidirectional arches at the top of said intersecting passages, said rebar tower further having a saddle formation at its apex. The rebar tower provides a tapered and angled foot profile at the bottom of each leg to minimize the area of contact when used with a concrete form, thereby reducing rebar support footprints after form removal. The rebar base comprises a platform with centrally rising bidirectional saddle formations, the intersecting passages and saddle formations of tower and base providing means for receiving the intersecting segments of rebars which are normal to each other. Locking insert hooks and guide tabs incorporated in the rebar base, and hook receptacles, guide ridges and restraining surfaces incorporated in the rebar tower provide complementary means for the attachment of the two structures to form a rigid, yet detachable tower-base assembly in multiple rebar grid configurations. The rebar base provides a stable support means when used individually or in tower-base assemblies on granular surfaces, such as sand or gravel beds.

12 Claims, 6 Drawing Sheets

(56) References Cited

U.S. PATENT DOCUMENTS

| | | | | |
|---|---|---|---|---|
| 6,354,054 | B1 * | 3/2002 | Verelli | E04C 5/168<br>248/440 |
| 7,451,580 | B2 * | 11/2008 | Kelly | E04C 5/20<br>52/637 |
| 7,810,298 | B1 * | 10/2010 | Sorkin | E04C 5/168<br>404/136 |
| 2011/0214381 | A1 * | 9/2011 | Alfonso | E04C 5/168<br>52/685 |
| 2014/0311081 | A1 * | 10/2014 | Parham | E04C 5/20<br>52/677 |

FOREIGN PATENT DOCUMENTS

| | | | | |
|---|---|---|---|---|
| WO | WO-2011127521 | A1 * | 10/2011 | E04C 5/10 |
| WO | WO-2012054959 | A1 * | 5/2012 | E04C 5/167 |

* cited by examiner

MULTIFUNCTIONAL REBAR SUPPORT SYSTEM FOR REINFORCEMENT OF CONCRETE STRUCTURES

FIELD OF THE INVENTION

This invention relates generally to rebar support devices or chairs, and more specifically to a rebar support apparatus comprising a tower and a base, each capable of holding rebar members at a predefined height above a concrete form or granular surface, respectively, the two further capable of being locked together by use of simple manual force, the assembly thereof acting in tower-base duplex fashion in the formation of rebar grids prior to concrete pouring.

BACKGROUND OF THE INVENTION

Steel reinforcing bars, commonly referred to as rebars, have long been used to improve the strength and durability of a wide range of concrete structures such as footings, foundations, walkways, platforms, support beams, building frames and the like, making reinforced concrete one of the most common building material used in the construction industry. The use of rebar in these structures involves the construction and securing of rebar grids at various heights above the bottom of a concrete form or granular base. Rebar support devices are used to position and hold rebar members in the formation of said reinforcing grids and therefore play an important role in the production of reinforced concrete structures.

Rebar support devices may be broadly grouped into three principal categories: 1. Unitary devices providing one or more levels of rebar support and designed for placement on a granular surface, such as a gravel bed. 2. Unitary devices providing one or more levels of rebar support and designed for placement on a solid surface, such as the bottom of a concrete form. 3. Multiple component devices which provide one or more levels of rebar support and also the means to configure the component parts thereof to permit use on either a granular surface or a solid surface in the construction of rebar grids.

It is appreciated that numerous rebar support devices are known in the art. Examples are U.S. Pat. No. 3,673,753 to Anderson, U.S. Pat. No. 6,354,054 to Verelli and Verelli, U.S. Pat. No. 6,684,594 to Sorkin, U.S. Pat. No. 7,451,580 to Kelly et al. and U.S. Pat. No. 7,870,702 to McKay.

Exemplary rebar support devices providing one or more levels of rebar support and designed for placement on a granular surface, such as a gravel bed, may be found in U.S. Pat. Nos. 3,673,753, 6,684,594 and 7,870,702, the disclosure provided in U.S. Pat. No. 3,673,753, being representative of this category. In U.S. Pat. No. 3,673,753, a concrete rebar support device is disclosed comprising a unitary base with upright pedestal, said pedestal portion having lower and upper clamping means at its apex, defining first and second intersecting passageways disposed normal to each other, for simultaneously receiving rebar members therein. Resilient detents and hook means incorporated in said lower and upper clamping means assist in keeping rebars in place once positioned.

In U.S. Pat. No. 6,354,054, there is disclosed a unitary rebar chair comprising a tower with four legs between which there are defined two intersecting passages for simultaneously receiving the intersecting portions of two rebars normal to each other, said tower further having a saddle formation at its apex to accept one or two additional rebar members to form a multilevel rebar grid. U.S. Pat. No. 6,354,054 is exemplary of unitary devices providing one or more levels of rebar support and designed for placement on a solid surface, such as the bottom of a concrete form.

U.S. Pat. No. 7,451,580, is exemplary of a multiple component device providing one or more levels of rebar support and means to configure the component parts thereof to permit use on either a solid or granular surface in the construction of rebar grids. In this disclosure a rebar chair comprises a first component tower with rebar cradle means at its top surface and four legs which diverge down from the top surface, terminating in tapered feet for minimal contact with a concrete form. A second component base, described therein as a sand plate and also known in the art as a bearing plate, has radially extending slots formed to engage the feet of first component tower structure, the combination first component tower and second component base allowing the assembly thereof to be used on a granular surface.

In summary, the prior art has evolved to provide varied and effective means for the positioning and support of rebar members in the construction of rebar grids in reinforced concrete structures. However, what has not been adequately addressed is the need for a simple and effective rebar support system comprising a minimal number of component parts, each component part individually providing means for rebar support in specific applications, the cooperative combination of the component parts thereof further extending the functionality and range of applications in the formation of rebar grids on different types of surfaces.

SUMMARY OF THE INVENTION

It is thus an object of the present invention to provide a rebar support system for the reinforcement of concrete structures, comprising a rebar support tower and a rebar support base, individually capable of supporting rebar members at a predefined height within a range of possible heights, first component rebar support tower being ideally suited for use with concrete forms and second component rebar support base being ideally suited for use with granular surfaces, the two further capable of acting together in tower-base duplex fashion in the construction of multilevel rebar grids on granular surfaces.

It is a further object of the present invention that said first component rebar support tower is capable of simultaneously receiving and supporting the intersecting portions of two sets of rebar members, one set at its apex and the other through its lower structure, each set comprising rebars which are normal to each other.

It is a further object of the present invention that said first component rebar support tower is suitably adapted for use with a concrete form, leaving a minimum of contact footprints after form removal, while still providing the strength and stability for the required functions of rebar support, grid construction and concrete pouring.

It is a further object of the present invention that second component rebar support base is capable of receiving the intersecting segments of two rebars which are normal to each other.

It is a further object of the present invention that said second component rebar support base is suitably adapted for use on a granular surface, such as a gravel bed, having sufficient surface area in contact with such a surface to provide strength and stability for the required functions of rebar support, grid construction and concrete pouring.

It is yet a further object of the present invention that said first component rebar support tower and second component rebar support base provide complementary means for simple manual attachment of the two thereof to form a secure, yet detachable tower-base assembly in multiple rebar grid configurations.

To achieve the forgoing objects, and in accordance with the purposes of the invention as embodied and broadly described herein, there is provided a rebar support system for the reinforcement of concrete structures, comprising a first component rebar support tower and a second component rebar support base.

According to an advantageous embodiment of first component rebar support tower according to the invention, the structure comprises four legs between which there are defined two intersecting passages, the legs being open-ended at the bottom and forming bidirectional arches at the top of said intersecting passages, said first component rebar support tower further having a saddle formation at its apex, the intersecting passages, bidirectional arches and saddle formation providing means for receiving the intersecting segments of rebars which are normal to each other.

According to another advantageous embodiment of first component rebar support tower according to the invention, there is provided a tapered and angled profile at the bottom of each leg to minimize the area of contact when used with a concrete form.

According to an advantageous embodiment of second component rebar support base according to the invention, there is provided a platform with centrally rising bidirectional saddle formations for receiving the intersecting segments of rebars which are normal to each other.

According to yet another advantageous embodiment according to the invention, there is provided hook receptacle means and guide ridges in first component rebar support tower and corresponding insert hooks and guide tabs in second component rebar support base, providing means for the manual attachment of the two structures to form a rigid, yet detachable tower-base assembly in the formation of multiple rebar grid configurations.

BRIEF DESCRIPTION OF THE DRAWINGS

Additional objects, features and advantages of the present invention will become more fully apparent from the accompanying description and appended claims taken in conjunction with the following drawings, wherein like reference characters indicate like elements throughout.

FIG. 2 illustrates various views of a fully interconnected tower-base assembly, in which:

(a) Is a front view of one side of the assembly, the opposite side being identical to that shown.

(b) Is a front view of the side adjacent to the side illustrated in (a), the opposite side being identical to that shown.

(c) Is a bottom angled view of a tower-base assembly.

(d) Is a top view of a tower-base assembly.

(e) Is a top angled view of a tower-base assembly.

Figure 3:
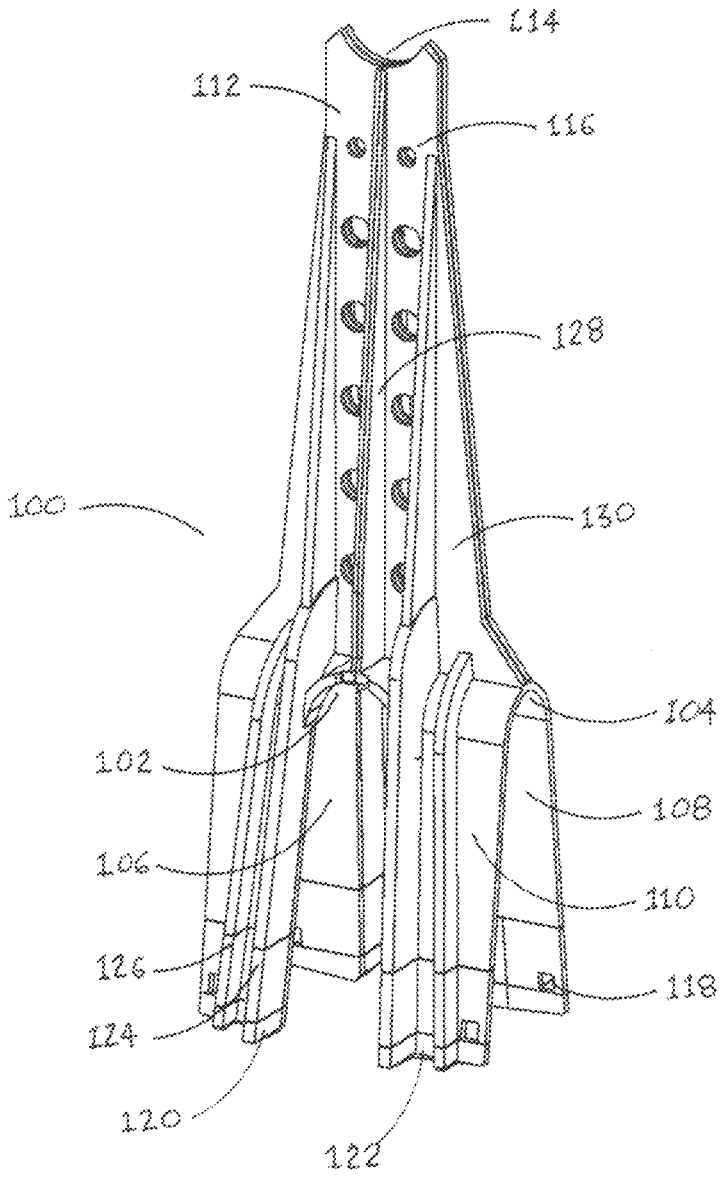

FIG. 3 illustrates a front angled view of a rebar support tower.

Figure 4:
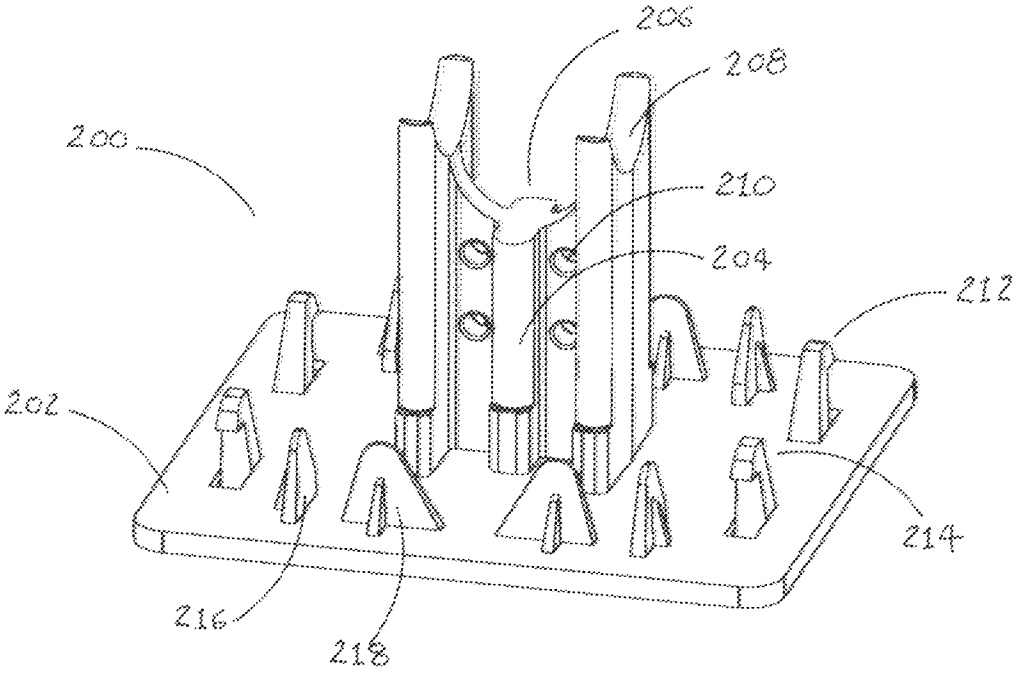

FIG. 4 illustrates a front angled view of a rebar support base.

Figure 5:
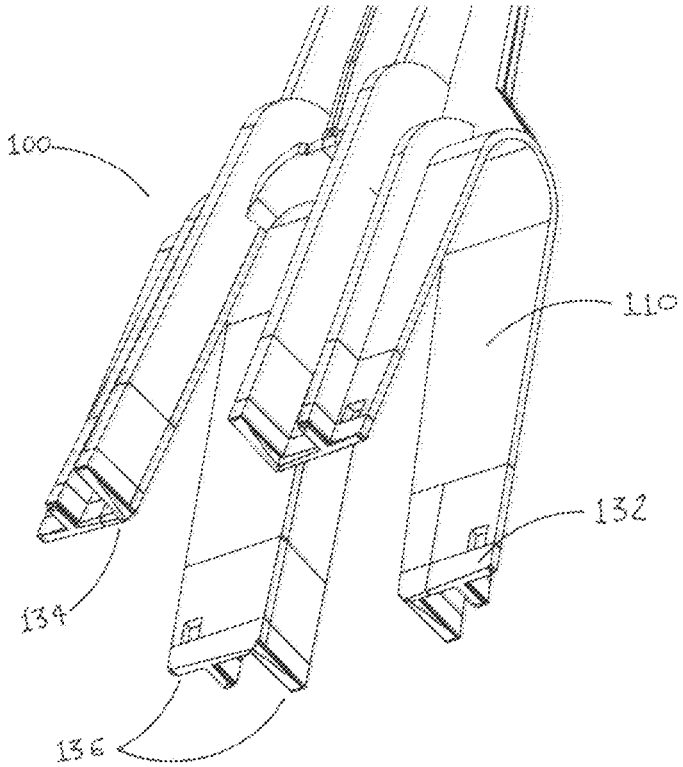

FIG. 5 illustrates an expanded bottom angled perspective of a rebar support tower.

Figure 6:
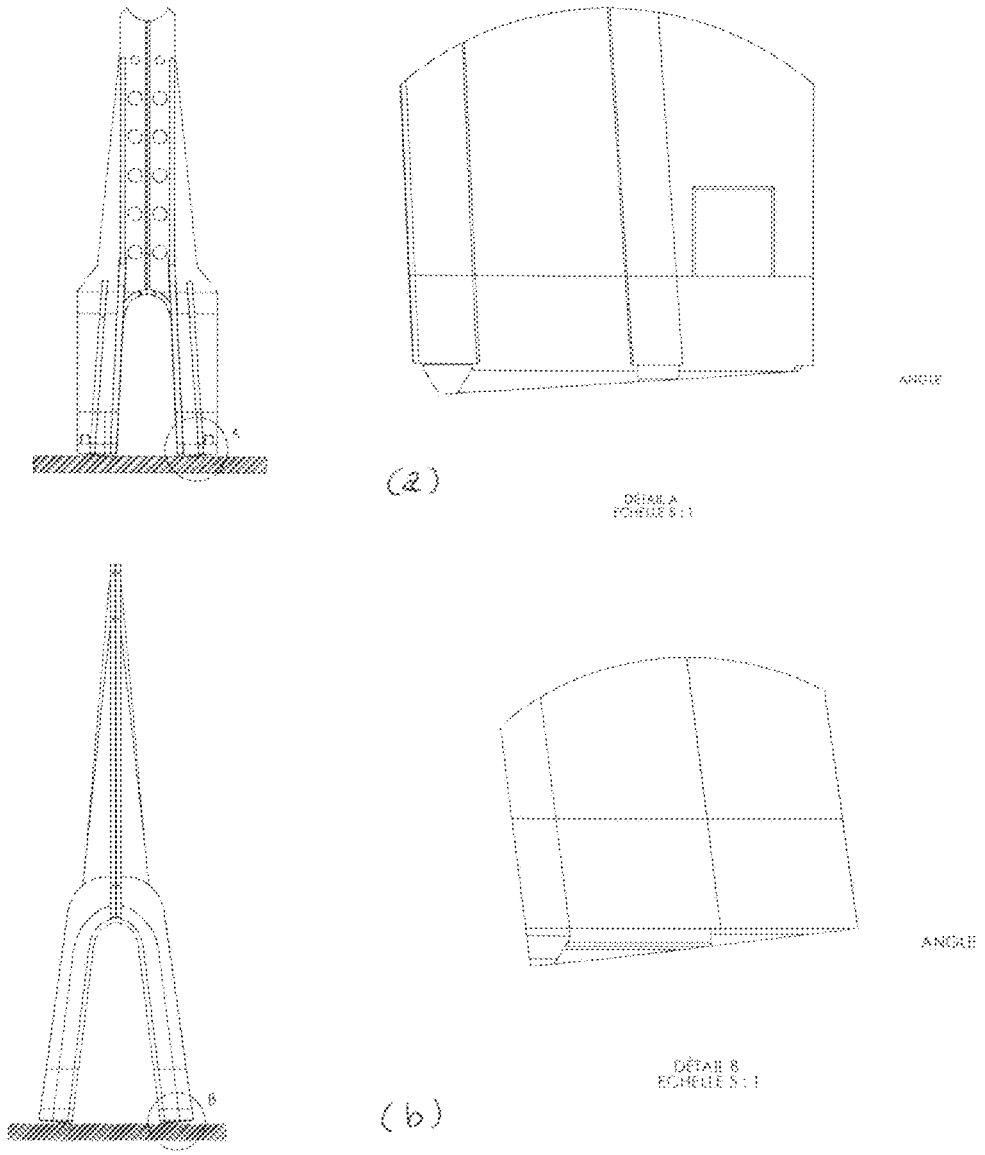

FIG. 6 illustrates a front view of one side of a rebar support tower positioned on a solid surface (a), the angled foot profile thereof highlighted in Detail A, (b) illustrating a front view of the side adjacent to the side illustrated in (a), highlighting the angled foot profile thereof, from a different perspective, Detail B.

DETAILED DESCRIPTION OF THE PREFERRED EMBODIMENTS

Figure 1:
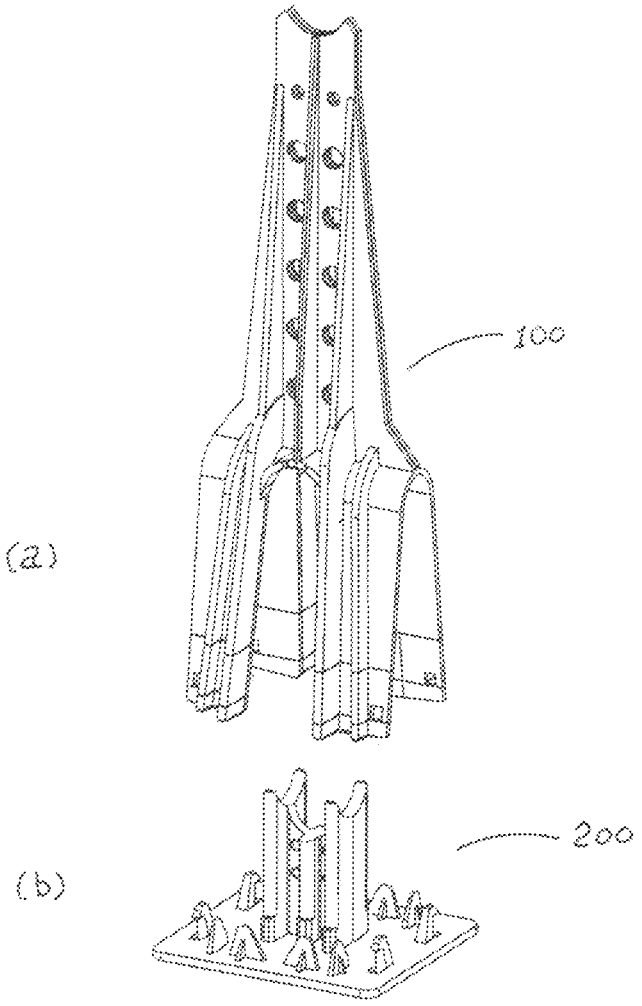
FIG. 1 illustrates a perspective view of a rebar support tower (a), and a rebar support base (b), the dashed lines further illustrating the modality of tower-base interconnection according to the principles of the invention.

In FIG. 1, there is illustrated a preferred embodiment of a rebar support system for the reinforcement of concrete structures according to the invention, comprising a rebar support tower 100 and a rebar support base 200, individually capable of holding rebar members at a predefined height above a supporting surface within a range of possible heights, the two further capable of acting together in tower-base duplex fashion in the construction of multilevel rebar grids, the dashed lines in FIG. 1, illustrating the modality of tower-base interconnection according to the principles of the invention. Rebar support tower 100 is individually suited for use with concrete forms by virtue of the small footprint left after form removal in applications where the underside of the concrete structure is exposed. Rebar support base 200 individually, or in tower-base combination, is suited to the construction of rebar grids on granular surfaces where the large contact area it provides offers a high degree of stability and the underside of the concrete structure thus formed is not visible.

Figure 2:
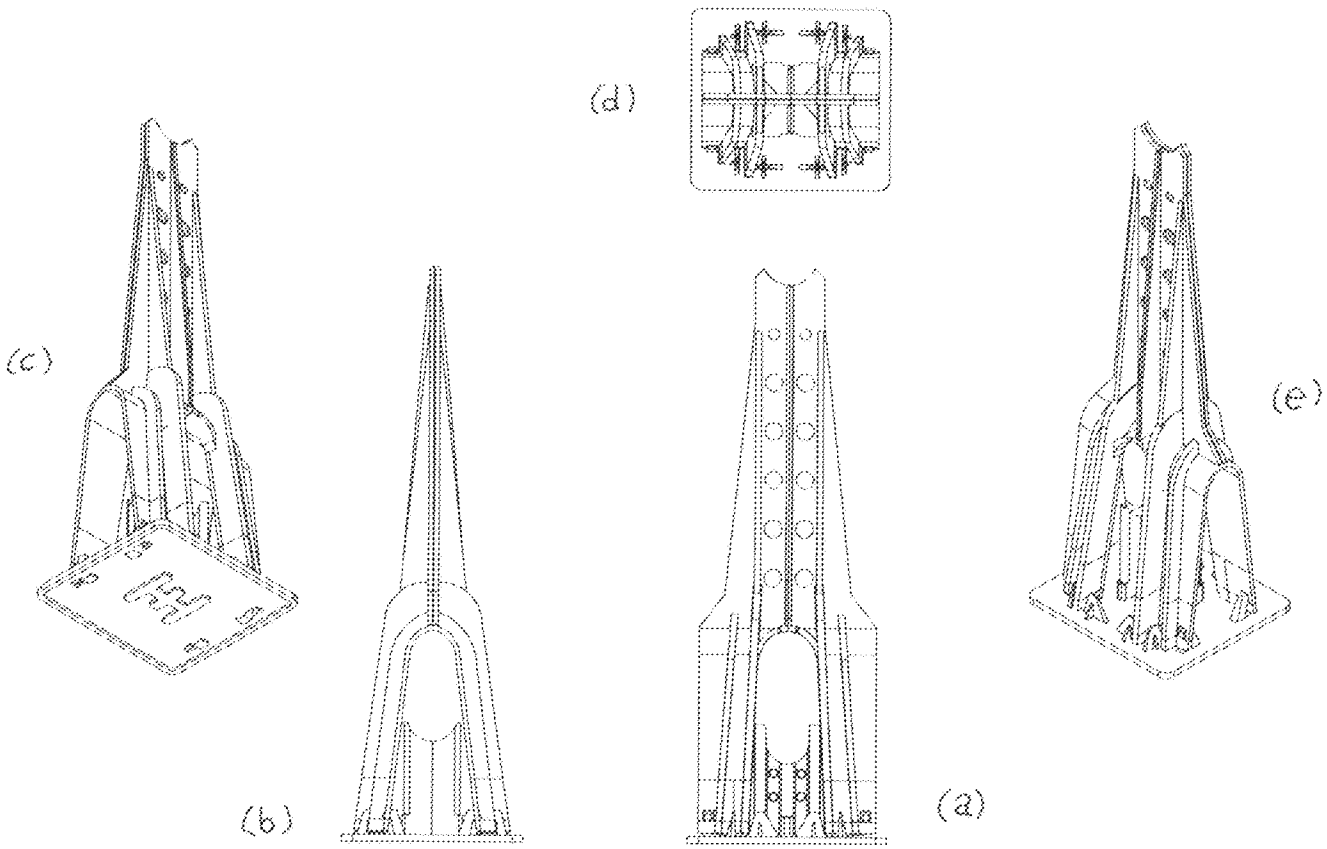

To further assist one skilled in the art and provide the basis for the detailed descriptions of the preferred embodiments and advantageous features of the invention which follow, there is illustrated in FIG. 2 a fully interconnected tower-base assembly, showing the various views thereof.

By way of example and not limitation, rebar support tower 100 and rebar support base 200 are preferably injection moulded out of high-strength thermoplastic material such as polyurethane, polypropylene, nylon or the like. Similarly, rebar support tower 100 and rebar support base 200 could be manufactured in various sizes to provide a range of practical rebar placement heights above a supporting surface, for example 9½"-12¼" and 2½"-3", respectively, in increments of ¼", the tower-base assembly thereof providing means for two levels of intersecting rebars, each level within the exemplary ranges indicated.

In FIG. 3, there is illustrated a rebar support tower 100 according to the invention, comprising a unitary body having two arches 102 and 104 disposed normal to each other, the top of the arches intersecting centrally within the tower and defining the top surface of first and second passages 106 and 108, respectively, said passages further defined by four legs 110, which diverge downwards from the body of the tower and remain open-ended at the bottom, the passages thus defined providing means for receiving and positioning at least one rebar or the intersecting portions of a top and bottom rebar at right angles to each other in the formation of a lower grid of intersecting rebars.

Rebar support tower 100 illustrated in FIG. 3, includes a centrally rising upper structure 112 having a saddle formation at its apex 114 for receiving at least one rebar or the intersecting portions of a top and bottom rebar at right angles to each other in the formation of an upper grid of intersecting rebars. Tie holes 116 are located along the height of structure 112 to permit rebars to be secured using tie wire in upper and lower levels of grid formations.

The lower portion of each leg of rebar support tower 100 provides means for interconnection with rebar support base 200, said means comprising hook receptacle holes 118, positioning and retaining surfaces 120 and 122, and guide ridges 124 and 126, which assist in aligning first component rebar support tower 100 and second component rebar support base 200 in forming a tower-base assembly, ridges 124, 126, 128 and 130 further providing structural strength and dimensional stability to rebar support tower 100.

In FIG. 4, there is illustrated a rebar support base 200 according to the invention, comprising a unitary body having a platform 202, with centrally rising upper structure 204 which terminates at its apex with bidirectional saddle formations 206 and 208, disposed at right angles to each other, the saddle formations thus formed providing means for receiving at least one rebar or the intersecting segments of a top and bottom rebar which are normal to each other. Tie holes 210 are located along the height of structure 204 to permit rebars to be secured using tie wire. Two sets of two opposing insert hooks 212 and 214, and four sets of two positioning and retaining tabs 216 and 218 incorporated in rebar support base 200, are complementary to hook receptacle holes 118, and positioning and retaining surfaces 120 and 122 respectively, of rebar support tower 100, the means thereof acting cooperatively to enable the interconnection of the two structures. The hook means provide resilient force when engaged with hook receptacle means, thereby preventing unintended vertical axis movement or disengagement of the two component parts, said tabs and surfaces further preventing horizontal axis (X-Y) movement, the resulting assembly thereby providing a strong and reliable structure for the required functions of rebar support, grid construction and concrete pouring.

In a preferred embodiment of rebar support tower 100, there is provided means for reducing the area of contact when used with a concrete form, in order to reduce rebar support footprints on the bottom of a concrete structure after form removal. FIG. 5 provides an expanded view of an exemplary embodiment to achieve this objective, comprising tapered and angled profiles at the bottom of each foot portion 132, of each leg 110, said tapered and angled profiles coming to a lower and smaller inner point 134 compared to their points of origin 136, inner point 134 of the four legs of the structure thus being the contact points with the concrete form and the only portion of rebar support structure visible after form removal.

In FIG. 6 (*a*) there is illustrates a front view of one side of a rebar support tower as it would appear positioned on a solid surface, the angled foot profile highlighted in Detail A. FIG. 6 (*b*) illustrates a front view of the side adjacent to the side illustrated in FIG. 6 (*a*), highlighting the angled foot profile from a different perspective, Detail B. It can be readily observed that the tapered and raised foot profile provided in the preferred embodiment of the invention serves to promote concrete flow underneath the foot portions of the structure, leaving only point contacts exposed and visible after concrete form removal.

It is apparent from the foregoing description that the apparatus of the present invention may incorporate different variants to fulfill a number of specific functional requirements encountered in the reinforcement of concrete structures. In particular, the two component apparatus disclosed herein comprises a rebar support tower having small footprint means, allowing it to function individually on a solid surface, such as a concrete form, providing five practical rebar support variants: 1. A single rebar member in its upper structure. 2. A single rebar member in each of its upper and lower structure. 3. A single rebar member in its upper structure and two intersecting rebars in its lower structure. 4. A single rebar member in its lower structure and two intersecting rebars in its upper structure. 5. Two intersecting rebar members in each of its upper and lower structure. The rebar support base of the invention provides a platform and rebar support means, allowing it to function individually on a granular surface, such as a gravel bed, providing two practical rebar support variants: 1. A single rebar member in its support structure. 2. Two intersecting rebar members in its support structure.

The rebar support tower and rebar support base of the invention comprise cooperative means for interconnecting one with the other in tower-base duplex fashion to hold rebar members at predefined heights in the construction of multilevel rebar grids on a granular surface, the practical functional variants of the assembly thereof being: 1. A single rebar member in its upper level. 2. A single rebar member in each of the upper and lower levels. 3. A single rebar member in the upper level and a pair of intersecting rebars at its lower level. 4. A single rebar member in the lower level and a pair of intersecting rebars at its upper level. 5. Two intersecting rebar members in each of its upper and lower levels.

From the foregoing description, it will be appreciated that this invention embraces the objectives of novelty and commercial/industrial utility. From a technical perspective, it is noted that from a two-component apparatus in which each component is individually capable of independent use, the two providing a combined total of seven possible functional variants when used individually, there results a total number of twelve possible functional variants with the simple manual interconnection of the two components thereof. Therefore, it will also be appreciated that this invention will have tangible advantages and benefits, both commercially and for the general public, through reduced inventory costs for suppliers and end-users, greater work-site efficiency and enhanced reliability, lower maintenance costs and increased life of end-product concrete structures, ubiquitous in cities today.

Finally, it will be appreciated that the principles of the invention as described herein can be applied in many ways and that the invention is not limited to those of its modes of employment, embodiments and uses which have been described explicitly. Rather, it encompasses all changes and modifications which may be derived by those skilled in the art and are within the spirit, scope and extent of the invention as set forth in the following claims.

What is claimed is:

1. A rebar support apparatus for the reinforcement of concrete structures for supporting above a surface a first rebar from an upper grid of rebars, a second rebar from a lower grid of intersecting rebars and a third rebar from the lower grid of intersecting rebars, the third rebar intersecting the second rebar at a right angle at an intersection point, the apparatus comprising:

a first component rebar support tower individually capable of supporting the first rebar from the upper grid of rebars at a first predefined height above the surface; and a second component rebar support base supporting the first component rebar support tower and being individually capable of supporting the second and third rebars from the lower grid of intersecting rebars at a second predefined height above the surface, the first component rebar support tower and the second component rebar support base being capable of acting together in a tower-base duplex fashion for supporting the first, second and third rebars from both the upper grid of rebars and the lower grid of intersecting rebars, wherein the first component rebar support tower is made of a tower unitary body comprising:

four supporting legs together forming a first arch defining a first rebar passage for receiving one of: the second rebar and the third rebar from the lower grid of intersecting rebars and a second arch defining a second rebar passage for receiving the other one of: the second rebar and the third rebar from the lower grid of intersecting rebars, the second arch being disposed normal to the first arch, each one of the four supporting legs defining a leg distal end being at a distance from the other one of the four supporting legs.

2. The apparatus according to claim 1, wherein the tower unitary body of the first component rebar support tower further comprises a centrally rising tower upper structure upwardly extending from the four supporting legs, the centrally rising tower upper structure defining a tower apex and comprising:

a first saddle formation at the tower apex for receiving the first rebar from the upper grid of rebars; and a first set of tie holes about the tower apex to permit the securing of the first rebar.

3. The apparatus according to claim 1, wherein each one of the four supporting legs comprises a foot portion at the leg distal end, the foot portion comprising a tapered and angled pad profile which comes to a smaller and lower inner point compared to its outer point of origin, the inner point thus defined being the only contact point with the surface on which the one of the four supporting legs rests, allowing concrete to flow around the four supporting legs and thereby being the only part of the first component rebar support tower visible after form removal, in an application where the first component rebar support tower is used individually to support the first rebar from the upper grid of rebars.

4. The apparatus according to claim 3, wherein the foot portion comprises means for interconnecting the first component rebar support tower with the second component rebar support base, the means comprising hook receptacle holes, positioning and retaining surfaces, and guide ridges.

5. The apparatus according to claim 4, wherein the hook receptacle holes function to lock together the first component rebar support tower with the second component rebar support base and to prevent vertical axis movement or disengagement of the first component rebar support tower and the second component rebar support base, wherein the positioning and retaining surfaces function to prevent horizontal axis (X-Y) movement of the first component rebar support tower relatively to the second component rebar support base once engaged together, and further wherein the guide ridges assist in the alignment of the first component rebar support tower with the second component rebar support base.

6. The apparatus according to claim 1, wherein the second component rebar support base is made of a base unitary body comprising:

a platform;

a centrally rising base upper structure upwardly extending from the platform and defining a base apex;

a second saddle formation at the base apex for receiving the second rebar from the lower grid of intersecting rebars;

a third saddle formation at the base apex for receiving the third rebar from the lower grid of intersecting rebars, the third saddle formation being disposed at a right angle from the second saddle formation allowing the second and third saddle formations to respectively support the second and third rebars at the intersection point;

a second set of tie holes about the base apex to permit the securing of at least one of: the second and third rebars.

7. The apparatus according to claim 6, wherein the platform defines a platform upper surface and further wherein the base unitary body further comprises:

two sets of two opposing insert hooks upwardly extending from the platform upper surface; and four sets of two positioning and retaining tabs extending from the platform upper surface, each hook and each positioning and retaining tab from the two sets of two opposing insert hooks and the four sets of two positioning and retaining tabs being complementary respectively to a corresponding hook receptacle hole of the hook receptacle holes, and further, to a corresponding positioning and retaining surface of the positioning and retaining surfaces of the first component rebar support tower;

the two sets of two opposing insert hooks, the four sets of two positioning and retaining tabs, the hook receptacle holes and the positioning and retaining surfaces acting cooperatively to enable the interconnection of the first component rebar support tower with the second component rebar support base, the two sets of two opposing insert hooks providing resilient force when engaged with the hook receptacle holes, preventing vertical axis movement or disengagement of the first component rebar support tower relatively to the second component rebar support base, the four sets of two positioning and retaining tabs preventing horizontal (X-Y) movement of the first component rebar support tower relatively to the second component rebar support base once engaged together.

8. A rebar support apparatus for the reinforcement of concrete structures adapted for supporting above a surface a first rebar from an upper grid of rebars, a second rebar from a lower grid of intersecting rebars and a third rebar from the lower grid of intersecting rebars, the apparatus comprising:

a first component rebar support tower individually capable of supporting the first rebar from the upper grid of rebars at a first predefined height above the surface; and a second component rebar support base supporting the first component rebar support tower and being individually capable of supporting the second and third rebars from the lower grid of intersecting rebars at a second predefined height above the surface;

wherein the first component rebar support tower is being made of a tower unitary body comprising:

four supporting legs together forming a first arch defining a first rebar passage for receiving one of: the second rebar and the third rebar from the lower grid of intersecting rebars and a second arch defining a second rebar passage for receiving the other one of: the second rebar and the third rebar from the lower grid of intersecting rebars, the second arch being disposed normal to the first arch, each one of the four supporting legs defining a leg distal end being at a distance from the other one of the four supporting legs, each one of the four supporting legs comprising a foot portion at the leg distal end, the foot portion comprising a tapered and angled pad profile which comes to a smaller and lower inner point compared to its outer point of origin, the four supporting legs comprising hook receptacle holes, positioning and retaining surfaces and guide ridges for interconnecting the first component rebar support tower with the second component rebar support base and stabilizing the apparatus thereof; and a centrally rising tower upper structure upwardly extending from the four supporting legs, the centrally rising tower upper structure defining a tower apex and comprising a first saddle formation at the tower apex for receiving the first rebar from the upper grid of rebars and a first set of tie holes about the tower apex to permit the securing of the first rebar;

wherein the second component rebar support base is being made of a base unitary body comprising:

a platform defining a platform upper surface; and integral hook receptacle means extending from the platform upper surface for interconnecting with the hook receptacle holes;

wherein the first component rebar support tower and the second component rebar support base are being capable of acting together in a tower-base duplex fashion for supporting the first, second and third rebars from both the upper grid of rebars and the lower grid of intersecting rebars in the construction of multilevel rebar grids;

wherein interconnecting the first component rebar support tower with the second component rebar support base is being effected by the hook receptacle holes incorporated in the first component rebar support tower and the integral hook receptacle means incorporated in the second component rebar support base.

9. The apparatus according to claim 8, wherein the second component rebar support base further comprises:

a centrally rising base upper structure upwardly extending from the platform and defining a base apex;

a second saddle formation at the base apex for receiving the second rebar from the lower grid of intersecting rebars;

a third saddle formation at the base apex for receiving the third rebar from the lower grid of intersecting rebars, the third saddle formation being disposed at a right angle from the second saddle formation allowing the second and third saddle formations to respectively support the second and third rebars at an intersection point.

10. A rebar support apparatus for the reinforcement of concrete structures adapted for supporting above a surface a first rebar from an upper grid of rebars, a second rebar from a lower grid of intersecting rebars and a third rebar from the lower grid of intersecting rebars, the apparatus comprising:

a first component rebar support tower individually capable of supporting the first rebar from the upper grid of rebars at a first predefined height above the surface; and a second component rebar support base supporting the first component rebar support tower and being individually capable of supporting the second and third rebars from the lower grid of intersecting rebars at a second predefined height above the surface;

the first component rebar support tower and the second component rebar support base being capable of acting together in a tower-base duplex fashion for supporting the first, second and third rebars from both the upper grid of rebars and the lower grid of intersecting rebars in the construction of multilevel rebar grids;

wherein the second component rebar support base is being made of a unitary body comprising:

a platform defining a platform upper surface;

a centrally rising base upper structure upwardly extending from the platform and defining a base apex;

a second saddle formation at the base apex for receiving the second rebar from the lower grid of intersecting rebars;

a third saddle formation at the base apex for receiving the third rebar from the lower grid of intersecting rebars, the third saddle formation being disposed at a right angle from the second saddle formation allowing the second and third saddle formations to respectively support the second and third rebars at an intersection point each other;

a set of tie holes about the base apex to permit the securing of at least one of: the second and third rebars from the lower grid of intersecting rebars;

two sets of two opposing insert hooks upwardly extending from the platform upper surface; and four sets of two positioning and retaining tabs extending from the platform upper surface, each hook and each positioning and retaining tab from the two sets of two opposing insert hooks and the four sets of two positioning and retaining tabs being complementary respectively to a corresponding hook receptacle hole of a plurality of corresponding hook receptacle holes, and a corresponding positioning and retaining surface of a plurality of corresponding positioning and retaining surfaces provided on the first component rebar support tower, the two sets of two opposing insert hooks, the four sets of two positioning and retaining tabs, the plurality of corresponding hook receptacle holes and the plurality of corresponding positioning and retaining surfaces acting cooperatively to enable interconnection of the first component rebar support tower with the second component rebar support base and stabilizing the apparatus thereof.

11. The apparatus according to claim 10, wherein the second component rebar support base is supported by the surface, where the surface is a granular surface.

12. The apparatus of claim 6, wherein the platform defines a platform upper surface and further wherein the base unitary body further comprises:

a plurality of positioning and retaining tabs extending from the platform upper surface acting cooperatively to enable alignment, positioning and retaining of the first component rebar support tower relatively to the second component rebar support base once supported thereon.

* * * * *